United States Patent [19]

Bogren

[11] Patent Number: 4,606,462

[45] Date of Patent: Aug. 19, 1986

[54] TUBULAR CONTAINER HAVING A TEAR OPENING MEANS

[76] Inventor: Ingemar S. B. Bogren, 193 00 Sigtuna, Sweden

[21] Appl. No.: 694,671

[22] PCT Filed: May 15, 1984

[86] PCT No.: PCT/SE84/00182

§ 371 Date: Jan. 7, 1985

§ 102(e) Date: Jan. 7, 1985

[87] PCT Pub. No.: WO84/04512

PCT Pub. Date: Nov. 22, 1984

[51] Int. Cl.[4] ..... B65D 3/04; B65D 17/40

[52] U.S. Cl. ..... 206/606; 206/612; 206/623

[58] Field of Search ..... 206/606, 612, 623, 627; 229/4.5

[56] References Cited

U.S. PATENT DOCUMENTS

| | | | |
|---|---|---|---|
| 2,608,341 | 8/1952 | Eckman | 206/606 |
| 3,145,906 | 8/1964 | Corriuet | 206/606 |
| 3,561,669 | 2/1971 | Postweiler et al. | 206/612 |
| 3,773,248 | 11/1973 | Cecil et al. | 206/606 |

FOREIGN PATENT DOCUMENTS

| | | | |
|---|---|---|---|
| 2046484 | 3/1972 | Fed. Rep. of Germany | 206/606 |
| 649764 | 12/1962 | Italy | 206/606 |

*Primary Examiner*—Stephen P. Garbe
*Attorney, Agent, or Firm*—James E. Nilles

[57] ABSTRACT

The powder proof container of this invention comprises end closures and a tubular sleeve that is formed from an initially flat rectangular blank of cardboard having an inner surface layer of weldable material. A pair of opposite side edges of the blank abut one another at a seam extending all along one side of the sleeve. A joining strip, adhered to the weldable material, extends across the butt joint and all along it to seal the seam. Cut lines in the sleeve, extending around it from a tongue at the seam, define a tear strip which is removable by outward pull on the tongue and removal of which divides the container into two parts that are hingedly connected by the joining strip.

5 Claims, 7 Drawing Figures

TUBULAR CONTAINER HAVING A TEAR OPENING MEANS

The present invention relates to a powder proof container made of a plane punched out blank having a base material of cardboard or similar stiff material which on the surface thereof that is to become the inner surface of the container has a layer of a weldable material, and which container is joined to form a tube which is closed at both ends.

A container of this type is known from applicant's own Swedish Pat. No. 8105334-0 (equivalent to U.S. patent application Ser. No. 414,056). A tubular container of this type is well suited for packing of different types of goods, both liquid and dry goods. A container of this type generally is made by welding a bottom and a lid internally in the container tube utilizing the weldable layer of material at the inner surface of the container. There may be certain difficulties in opening such a container, and generally to open the container the top is cut through by means of a knife. There is also a possibility of providing a special tear open lid in the container. After the container has been opened the contents of the container tube must be consumed in one step or a separate reclosing lid must be applied to the container.

For facilitating the opening and emptying of the container and for providing a container having its own reclosing lid it would be an advantage if the container could be opened by a tear opening means extending round the tubes, whereby the tear opening separates the upper part of the container which can later be used as a reclosing lid. Tear opening means are previously known comprising a tear wire which from the inside of the container cuts the tube material through. The application of such tear wires, however, involves complicated and expensive steps in the manufacture of the container. It may also be difficult to cut through a weldable inner layer of the tube by means of a tear wire since the weldable layers of material generally are tenacious in their nature. It may also happen that the tear wire comes loose before having torn round the entire tube. Often tubular containers of this type are made with a longitudinally extending overlapped joint, and of course there are special problems in having a tear wire or a similar tear means cut through the double layer of material at the overlap joint.

The object of the invention therefore is to provide a powder proof container of the type mentioned above which is formed with a tear opening means extending round the container tube and which provides a simple, safe and quick separation of the upper part of the container tube, which separated part later can be used as a reclosing lid.

According to the invention the container tube is butt joined (edge to edge) and is kept together under sealed conditions by a joining strip extending along the entire joining edges and applied to the weldable layer at the inner surface of the container. The container is formed with a tear opening means extending round the entire container and the tear opening means is constructed in that the cardboard layer is partly cut through along two all around extending lines and to a depth ending some distance from the inner weldable layer of material, and said weldable layer of material in turn is cut through along cut lines extending all around the tube and provided inside of the two punch lines of the cardboard material and at a slight distance in said cardboard base material. At one edge the cardboard base material with the weldable inner layer has a portion projecting over the side edge and in contact with the outer surface of the container tube adjacent the longitudinal edge joint, and the said sidewardly projecting portion provides a tongue which can be seized by the fingers for enabling a tear opening of the container.

Further characteristics of the invention will be evident from the following detailed description in which reference will be made to the accompanying drawings. It is, however, to be understood, that the embodiments of the invention described and shown in the drawings are only illustrative examples and that many different modifications may be presented within the scope of the appended claims.

In the drawings

FIG. 1 is a perspective view of a container tube according to the invention having an all around extending tear opening means which is partly opened.

FIG. 2 correspondingly shows a completely opened container according to the invention.

Figure 7:
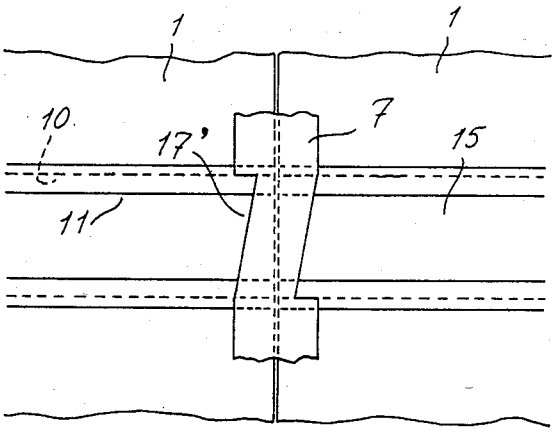

FIG. 7 finally shows a part of the container seen from inside at the area of the tear opening means.

The container shown in the drawings generally comprises a container tube or sleeve 1 which is closed at the bottom and at the top by means of a top closure 2. The sleeve and the top closure may be made of different materials, but preferably they are made of the same type of material having a body or base 3 of cardboard, an intermediate layer 4 of a material which can absorb heat, especially high frequency heat or ultrasonic heat, and an inner layer 5 of a weldable material. A material which is suited for this purpose and which is often used in making containers is a laminate of cardboard 3, aluminum 4 and polyethylene which material is supplied ready laminated by the paper mills.

Figure 1:
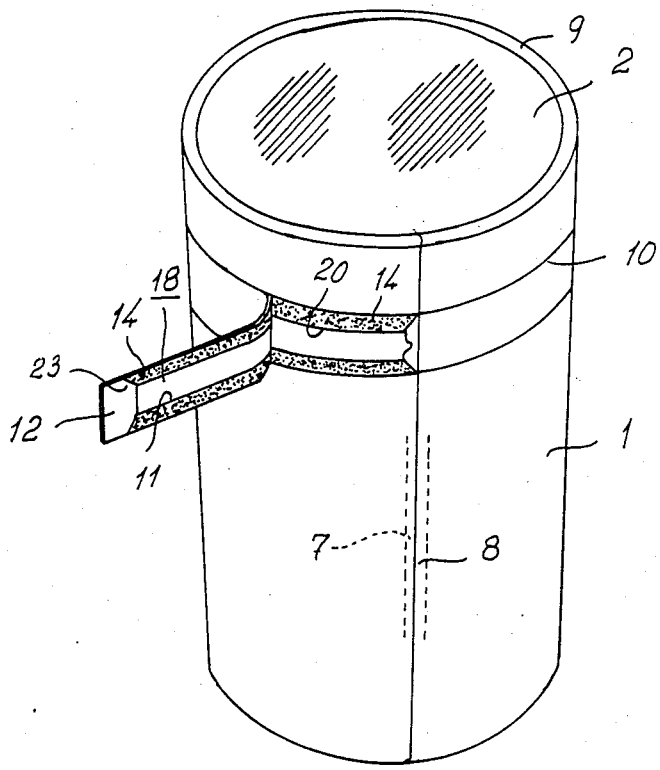
Figure 2:
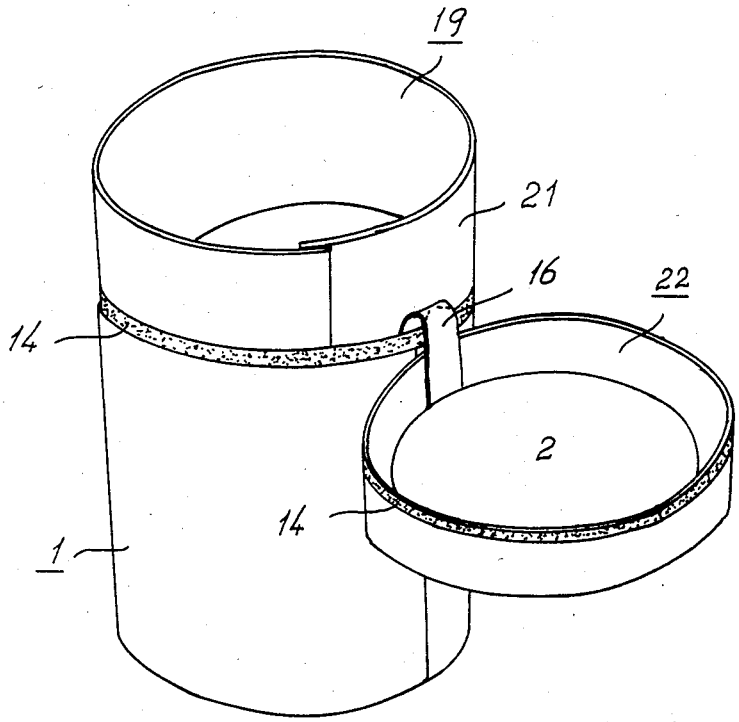
Figure 3:
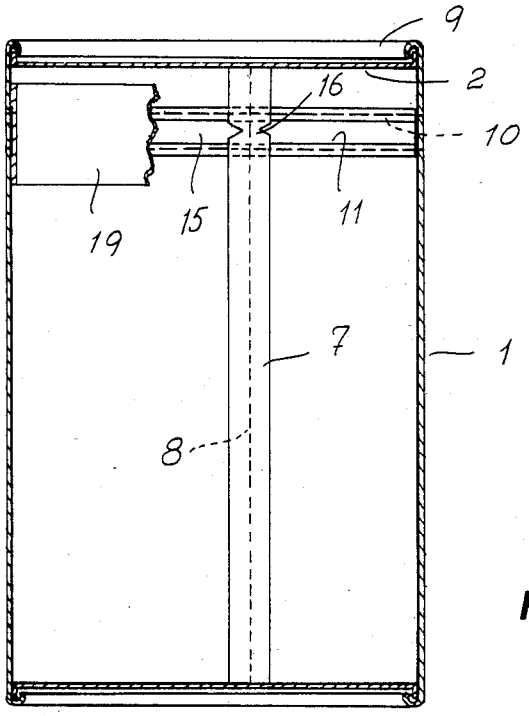
FIG. 3 is a vertical cross section through a container according to the invention.
Figure 4:
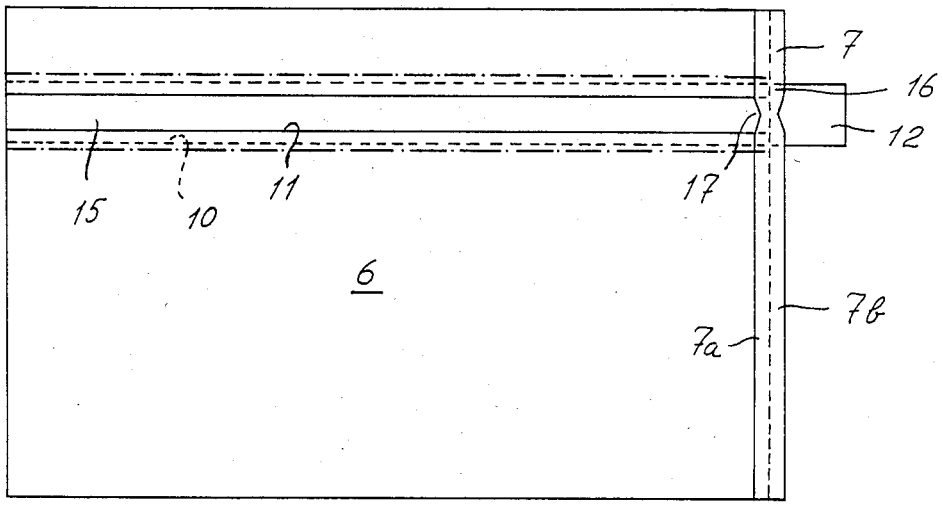
FIG. 4 shows a blank for making a container tube.
Figure 5:
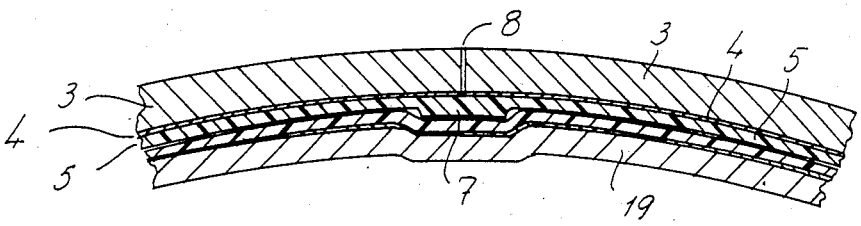
FIG. 5 is a fragmentary cross section view through the area round the longitudinal edge joint of the container tube.
Figure 6:
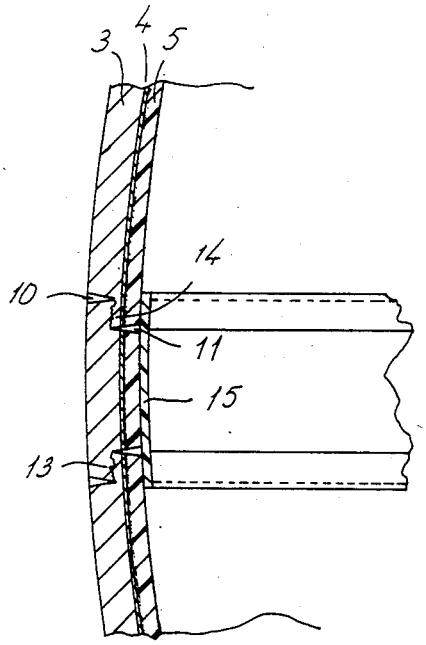
FIG. 6 is a cross section of the area round the tear opening means.

The planely punched out blank for the container sleeve 6, which is shown in FIG. 4 from inside the container to be made is formed with a joining strip 7 at one edge. One half *7a* of the joining strip is attached to the inner surface of the blank 6, for instance by being high frequency welded or ultrasonically welded, and the second half *7b* of the joining strip is free hanging outside the sleeve blank 6. The joining strip 7 may be a laminate of aluminum with a suitable weldable resin material and is attached with the weldable resin layer facing the inner layer of the blank 6 so that said strip is welded to the blank with plastic to plastic layers. The joining of the blank to bring it to sleeve form is made edge to edge in the form of a so called butt joint, and the free hanging part *7b* of the joining strip thereby is melted to fuse its plastic with the plastic layer 5 of the container sleeve. Some portion of the plastic material also creeps into the butt joint 8 thereby providing a joining of the facing edges of the cardboard material 3.

The top closure 2 and the bottom closure may be of the same material as the container sleeve, and it is preferably secured in the container sleeve by being formed with an upwardly extending edge ring that is pressed into the sleeve end and welded together with the inner layer of the sleeve by means of high frequency techniques or ultrasonic techniques.

After the container is closed at the top and at the bottom the top and bottom edges 9 preferably are curled inwards in order to give an attractive and stabilizing ending of the tubular container. In order to make it possible to tear open the container round the container sleeve the cardboard layer 3 is formed with two parallel punch lines 10 which extend partway into the the cardboard layer from the outer surface thereof, to have a depth such as to be some distance from the inner intermediate layer 4 and weldable layer 5. Also the intermediate layer 4 and the weldable layer 5 are cut through by means of two parallel cut lines 11 which are between the two punch lines 10 and spaced from both of them and which are of a depth to extend through the entire inner layer 5 and intermediate layer 4 and a slight distance into the cardboard material. For providing a grab tongue 12 the blank 6 is formed with a projecting part at the side edge thereof formed with a joining strip 7. The grab tongue is provided as an extension of the area of the blank between the carboard punched lines 10. The grab tongue 12 is loosely engaging the inner surface of the adjacent end of the sleeve 1. Since both the inner plastic layer 5 and the intermediate layer 4 of the sleeve are punched through from inside and the cardboard layer is punched through from outside it is possible to simply tear open the container, whereby the cardboard layer 3 is split along two elongated areas 13 which mainly extend between the two pairs of punch lines 10 and 11. The broken up surfaces therefore extend through the base material itself leaving a little part 14 of the cardboard material against which the tear opening can be made to obtain a neat tear edge. The punch and cut lines 10 and 11 preferably are provided so that the points of the two pairs of lines are located on the same depth of the cardboard material 3, but variations may be made depending on different types of material.

If a sealed container is wanted a sealing strip 15 preferably is provided at the inside of the container, which strip is wide enough to extend over the two inner cut lines 11. The sealing strip is sealed by connected, for instance welded to the inner plastic layer 5. The sealing strip 15 may be of any type of sealing material and also can be an aluminum-polyethylene laminate or a simple plastic film which can easily be torn or broken. The sealing strip 15 is applied already to the blank 6 as indicted with the phantom lines of FIG. 4. The sealing strip extends over the grab tongue 12, and when tear opening the container a tear power is applied both to the sealing strip 15 and to the cardboard material 3, the intermediate layer 4 and the inner layer 5 between the punched lines 10 and 11. The sealing strip 15 can be applied to the blank before or after the joining strip 7 is connected. If the sealing strip 15 is applied before the joining strip 7 a portion 16 of the joining strip 7 provides a foldable joint by means of which the lid is connected to the sleeve after the container is torn open. If, on the other hand the sealing strip 15 is applied after the joining strip 7, that is as an inner layer of the container, the joining strip is broken up when the container is torn open, whereby the lid can be completely separated from the container. For facilitating a tear opening of the container in the last mentioned case, or alternatively for facilitating a tearing off of the joining strip 7 before or after the lid is lifted off, the joining strip 7 can be formed with weakened portions 17 as shown in FIG. 4. An alternative embodiment of such weakened portions 17' giving a neat and straight tearing off is shown in FIG. 7.

Since a remainder of cardboard material 14 is left of the base material 3 when the tear strip 18 is torn off the sealing strip 15 can be torn off along a neat and straight edge against said remainder portion 14 of the cardboard material and the parts of the intermediate layer 4 and the inner layer 5 connected thereto.

In order to make it possible to reclose the torn off lid the container can be formed with an inner support ring 19 of a type known per se. Said support ring 19 is provided at the inside of the sleeve before the top closure 2 is connected. It is sufficient that the support ring 19 extends only a slight distance above the slot 20 that is provided when the tear strip 18 is torn off, whereby the part 21 of the support ring 19 extending above the opened edge of the sleeve provides a carrier for the torn off lid 22. The start of a tear opening can be facilitated by forming the tear strip 18, as known per se, with tear guide lines 23 provided so that the sealing of the container is maintained.

I claim:

1. A container comprising a tubular sleeve having opposite end portions and a pair of end closures secured to said end portions to close the sleeve, said sleeve being formed from an initially flat substantially rectangular blank of a stiff base material, such as cardboard, that has a layer of weldable material over the surface thereof that is at the interior of the sleeve, said blank having a pair of opposite end edges which are at the end portions of the sleeve and having a pair of opposite side edges which are adjacent to one another at a side seam extending along the sleeve from one to the other of its said end portions, said container being characterized by:

A. a joining strip at the interior of the sleeve and adhering to said weldable layer, overlapping the margins of the blank at its side edges and all along said side seam to hold said side edges in abutting relationship to one another and seal the side seam;

B. said blank having a tear opening tongue which is spaced from both of said end edges of the blank and which projects from one of said side edges and across the other one and overlies the exterior surface of the sleeve near the side seam;

C. said sleeve having therein an outer pair and an inner pair of spaced apart cut lines all of which extend around the sleeve parallel to said end edges of the blank and which cooperate to define a tear strip that is removable by pulling outward on the tongue and removal of which divides the container into two parts that are hingedly connected with one another by said joining strip, (1) said outer cut lines being substantially aligned, respectively, with opposite edges of the tongue and extending partway into the base material from the outer surface thereof, and (2) said inner cut lines being between said outer cut lines and spaced from both of them and extending from the inner surface of the blank through said weldable material and partway into the base material.

2. The container of claim 1, further characterized by:

D. an elongated readily tearable sealing strip overlying and adhered to the inner surface of said sleeve and said tongue and extending lengthwise around the interior of said sleeve, said sealing strip being wider than the distance between said inner cut lines and extending widthwise across them to provide a seal against leakage through them.

3. The container of claim 2, further characterized in that said sealing strip lies between said joining strip and the inner surface of the blank to be removable with said tear strip without breaking the hinge connection provided by said joining strip.

4. The container of claim 1, further characterized in that said joining strip has a weakened portion in the area thereof that is between said inner cut lines whereat it can be readily torn through to break the hinged connection that it provides.

5. The container of claim 1 wherein said sleeve has upper and lower ends and wherein said cut lines are near the upper end thereof, further characterized by:

D. a support ring in the interior of the sleeve having a bottom portion secured to the inner surface of the sleeve, substantially all around the same, below both of said inner cut lines and which extends upwardly therefrom for receiving the upper one of the two parts into which the container is divided after removal of the tear strip, which upper part telescopes thereover to serve as a closure.

* * * * *